US010961650B2

(12) United States Patent
Chun et al.

(10) Patent No.: US 10,961,650 B2
(45) Date of Patent: Mar. 30, 2021

(54) INNER DOOR ASSEMBLY AND DOOR FOR DRUM WASHING MACHINE AND DRUM WASHING MACHINE HAVING THE SAME

(71) Applicant: Samsung Electronics Co., Ltd, Suwon-si (KR)

(72) Inventors: Kwang-min Chun, Suwon-si (KR); Hwa-shik Kim, Suwon-si (KR); Hong-yeol Lee, Yongin-si (KR); Hee-tae Lim, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 245 days.

(21) Appl. No.: 15/601,995

(22) Filed: May 22, 2017

(65) Prior Publication Data

US 2017/0342621 A1 Nov. 30, 2017

(30) Foreign Application Priority Data

May 26, 2016 (KR) ..... 10-2016-0064993

(51) Int. Cl.

| | |
|---|---|
| ***D06F 23/00*** | (2006.01) |
| ***D06F 39/14*** | (2006.01) |
| ***E06B 5/00*** | (2006.01) |
| *D06F 37/28* | (2006.01) |

(52) U.S. Cl.

CPC ..... *D06F 23/00* (2013.01); *D06F 39/14* (2013.01); *E06B 5/006* (2013.01); *D06F 37/28* (2013.01)

(58) Field of Classification Search

None

See application file for complete search history.

(56) References Cited

U.S. PATENT DOCUMENTS

| | | | | |
|---|---|---|---|---|
| 6,748,771 | B2 | 6/2004 | Nitschmann et al. | |
| 7,478,502 | B2 | 1/2009 | Bienick et al. | |
| 7,549,305 | B2 | 6/2009 | Yun et al. | |
| 2007/0017258 | A1* | 1/2007 | Son | D06F 39/14 68/3 R |
| 2007/0256459 | A1* | 11/2007 | Yoon | D06F 37/28 68/139 |
| 2011/0023559 | A1* | 2/2011 | Schone | D06F 37/28 68/212 |

(Continued)

FOREIGN PATENT DOCUMENTS

| | | | |
|---|---|---|---|
| DE | 4304009 | A1 | 8/1994 |
| DE | 102009047595 | A1 | 6/2011 |

(Continued)

OTHER PUBLICATIONS

Extended European Search Report for European Application No. 17157908.9, dated Sep. 7, 2017. (7 pages).

(Continued)

*Primary Examiner* — Cristi J Tate-Sims

(57) ABSTRACT

An inner door assembly for a drum washing machine includes an inner door internal shell formed of plastic and including a rim portion and a projecting portion projecting from the rim portion; and an inner door external shell formed of metal and including a rim portion and a projecting portion corresponding to the rim portion and the projecting portion of the inner door internal shell, wherein the inner door external shell is combined not to be separated from the inner door internal shell.

20 Claims, 16 Drawing Sheets

(56) References Cited

U.S. PATENT DOCUMENTS

| | | | | |
|---|---|---|---|---|
| 2012/0007482 | A1* | 1/2012 | Pillot | D06F 37/28 312/228 |
| 2015/0069889 | A1* | 3/2015 | Kim | D06F 39/14 312/228.1 |
| 2016/0369445 | A1* | 12/2016 | Kim | D06F 39/14 |

FOREIGN PATENT DOCUMENTS

| | | | |
|---|---|---|---|
| EP | 2415920 | A1 | 2/2012 |
| EP | 3000925 | A1 | 3/2016 |
| KR | 10-2005-0108614 | A | 11/2005 |
| KR | 10-2006-0007262 | A | 1/2006 |
| WO | 2006009363 | A1 | 1/2006 |

OTHER PUBLICATIONS

Notice of Preliminary Rejection in connection with Korean Application No. 10-2016-0064993 dated Jul. 20, 2020, 10 pages.
Communication pursuant to Article 94(3) EPC dated Jan. 25, 2021 in connection with European Application No. 17157908.9, 4 pages.
Notice of Decision of Rejection dated Jan. 28, 2021 in connection with Korean Application No. 10-2016-0064993, 7 pages.

* cited by examiner

INNER DOOR ASSEMBLY AND DOOR FOR DRUM WASHING MACHINE AND DRUM WASHING MACHINE HAVING THE SAME

CROSS-REFERENCE TO RELATED APPLICATION(S) AND CLAIM OF PRIORITY

This application claims priority from Korean Patent Application No. 10-2016-0064993 filed May 26, 2016 in the Korean Intellectual Property Office, the disclosure of which is incorporated herein by reference in its entirety.

BACKGROUND

The present disclosure relates to a drum washing machine. More particularly, the present disclosure relates to an inner door assembly and a door for a drum washing machine, and a drum washing machine having the same.

Generally, a washing machine is an electric device that removes contaminants attached to laundry by chemical decomposition and mechanical impact. Such a washing machine may be classified into a pulsator washing machine that impacts laundry by a pulsator, and a drum washing machine that drops laundry by rotation of a drum to impact the laundry according to a method of impacting laundry.

The drum washing machine is widely used because the drum washing machine may reduce its height compared with a pulsator washing machine in which a rotating washing tub is disposed in a vertical state and tangling of the laundry may be minimized.

The drum washing machine is provided with a laundry loading opening for inserting and removing laundry and a door for opening and closing the laundry loading opening in a front surface of a washing machine body. Therefore, the door for the drum washing machine is hinged to one side of the laundry loading opening.

Further, the door for the drum washing machine is formed in a convex shape projecting toward the inside of the drum washing machine body, and the convex portion is formed of a transparent glass material. Accordingly, a user can see the laundry contained in the drum washing machine through the transparent glass of the door for the drum washing machine.

However, since the door for a drum washing machine according to the related art is formed of a glass material, the machinability is poor. Therefore, there is a problem that it is difficult to make various designs of the door.

In addition, since the conventional door for a drum washing machine is heavy in weight of glass, the drum washing machine is not easy to handle and the manufacturing cost is high.

Further, since the conventional door for the drum washing machine is made of a transparent glass, it is difficult to further dispose another part inside the door.

SUMMARY

The present disclosure has been developed in order to overcome the above drawbacks and other problems associated with the conventional arrangement. An aspect of the present disclosure relates to an inner door assembly of a door for a drum washing machine that is formed of a material different from glass so that the inner door assembly can be easily processed and handled, a manufacturing cost of the inner door assembly can be reduced, it is easy to further dispose another part inside the inner door assembly, and a design freedom of the inner door assembly is high, and a door for a drum washing machine and a drum washing machine including the same.

According to an aspect of the present disclosure, an inner door assembly for a drum washing machine may include an inner door internal shell formed of plastic and including a rim portion and a projecting portion projecting from the rim portion; and an inner door external shell formed of metal and including a rim portion and a projecting portion corresponding to the rim portion and the projecting portion of the inner door internal shell, wherein the inner door external shell is combined not to be separated from the inner door internal shell.

The rim portion of the inner door external shell may include a curling portion, and the curling portion of the inner door external shell may be fixed to the rim portion of the inner door internal shell by a curling process.

The rim portion of the inner door internal shell may be provided with a plurality of fixing protrusions, and the rim portion of the inner door external shell may be provided with a plurality of fixing grooves into which the plurality of fixing protrusions are inserted.

The projecting portion of the inner door internal shell may be provided with a first opening, and the projecting portion of the inner door external shell may be provided with a second opening corresponding to the first opening.

The second opening of the inner door external shell may be provided with a curling portion which wraps a circumference of the first opening of the inner door internal shell.

The inner door internal shell may be formed by an injection process.

The inner door external shell may be formed by pressing stainless steel.

According to another aspect of the present disclosure, a door for a drum washing machine may include an inner door assembly inserted into a laundry loading opening of the drum washing machine; and a door frame including a fixing hole into which the inner door assembly is inserted, and disposed in the drum washing machine so that the inner door assembly opens and closes the laundry loading opening of the drum washing machine, wherein the inner door assembly may include an inner door internal shell formed of plastic and including a rim portion and a projecting portion projecting from the rim portion; and an inner door external shell formed of metal and including a rim portion and a projecting portion corresponding to the rim portion and the projecting portion of the inner door internal shell, wherein the inner door external shell is combined not to be separated from the inner door internal shell.

An additional laundry loading passage connected to the first opening may be provided inside the projecting portion of the inner door internal shell.

A lip may be provided in an end of the additional laundry loading passage.

According to another aspect of the present disclosure, a drum washing machine may include a washing machine body including a laundry loading opening into which laundry is introduced; and a door disposed in the washing machine body to open and close the laundry loading opening, wherein the door may include an inner door assembly inserted into the laundry loading opening; and a door frame including a fixing hole to which the inner door assembly is fixed, and disposed by a hinge in the drum washing machine so that the inner door assembly opens and closes the laundry loading opening, wherein the inner door assembly may include an inner door internal shell formed of plastic and including a rim portion and a projecting portion projecting from the rim portion; and an inner door external shell formed of metal and including a rim portion and a projecting portion corresponding to the rim portion and the projecting portion of the inner door internal shell, wherein the inner door external shell is combined not to be separated from the inner door internal shell.

Other objects, advantages and salient features of the present disclosure will become apparent from the following detailed description, which, taken in conjunction with the annexed drawings, discloses preferred embodiments.

BRIEF DESCRIPTION OF THE DRAWINGS

These and/or other aspects and advantages of the present disclosure will become apparent and more readily appreciated from the following description of the embodiments, taken in conjunction with the accompanying drawings of which.

Throughout the drawings, like reference numerals will be understood to refer to like parts, components and structures.

DETAILED DESCRIPTION

Hereinafter, certain exemplary embodiments of the present disclosure will be described in detail with reference to the accompanying drawings.

The matters defined herein, such as a detailed construction and elements thereof, are provided to assist in a comprehensive understanding of this description. Thus, it is apparent that exemplary embodiments may be carried out without those defined matters. Also, well-known functions or constructions are omitted to provide a clear and concise description of exemplary embodiments. Further, dimensions of various elements in the accompanying drawings may be arbitrarily increased or decreased for assisting in a comprehensive understanding.

The terms "first", "second", etc. may be used to describe diverse components, but the components are not limited by the terms. The terms are only used to distinguish one component from the others.

The terms used in the present application are only used to describe the exemplary embodiments, but are not intended to limit the scope of the disclosure. The singular expression also includes the plural meaning as long as it does not differently mean in the context. In the present application, the terms "include" and "consist of" designate the presence of features, numbers, steps, operations, components, elements, or a combination thereof that are written in the specification, but do not exclude the presence or possibility of addition of one or more other features, numbers, steps, operations, components, elements, or a combination thereof.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

Figure 1:
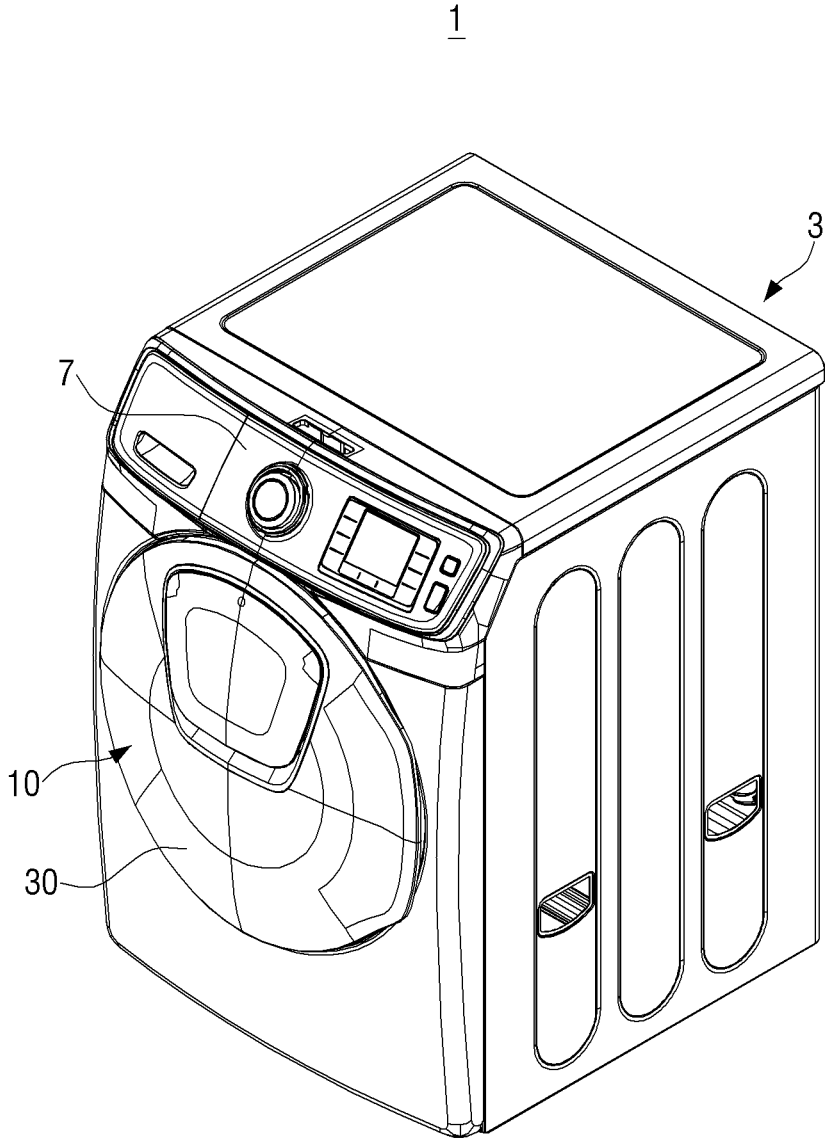
FIG. 1 is a perspective view illustrating a drum washing machine according to an embodiment of the present disclosure.
Figure 2:
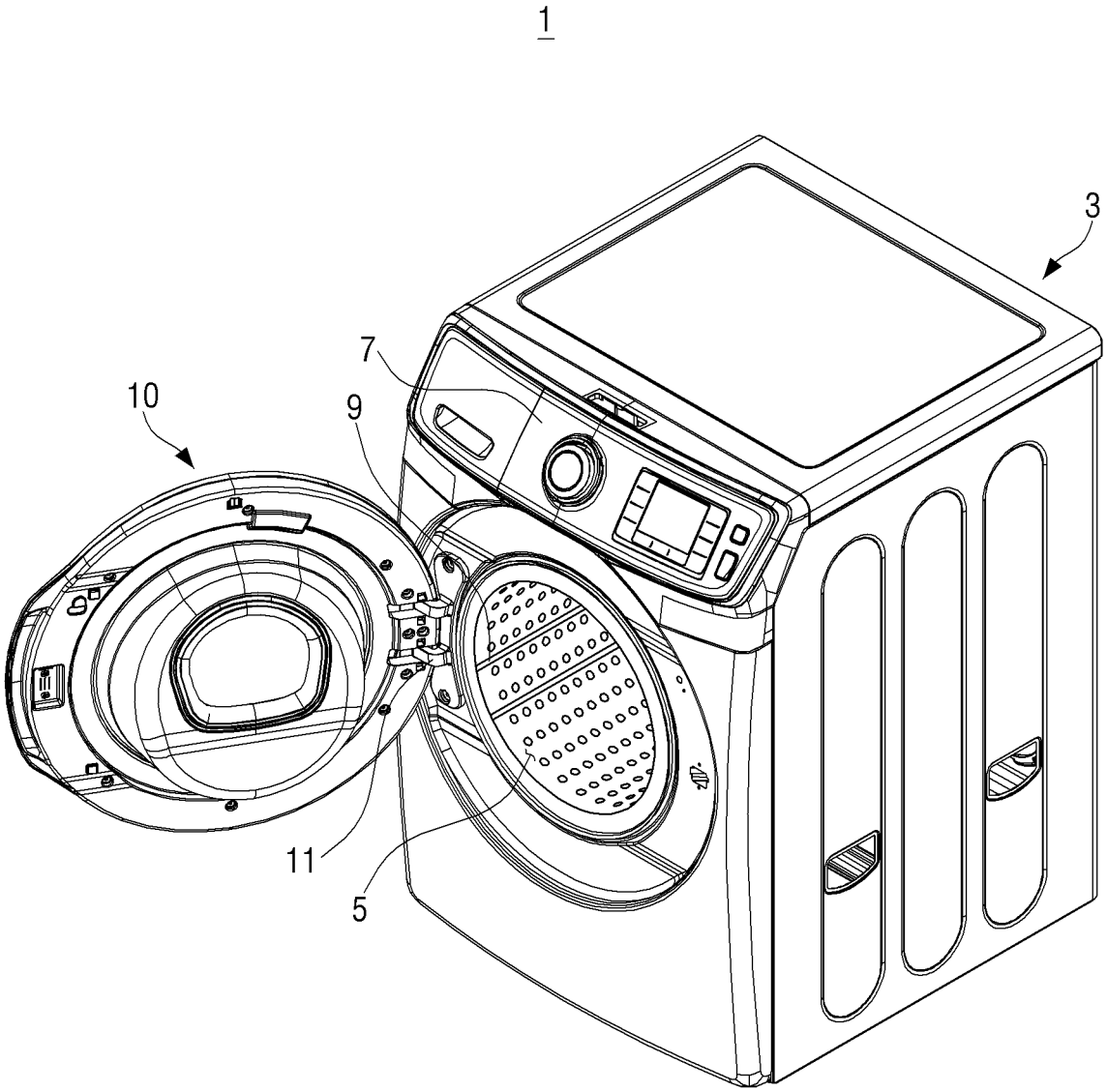
FIG. 2 is a perspective view illustrating a state in which a door of the drum washing machine of FIG. 1 is open.

FIG. 1 is a perspective view illustrating a drum washing machine according to an embodiment of the present disclosure, and FIG. 2 is a perspective view illustrating a state in which a door of the drum washing machine of FIG. 1 is open.

Referring to FIGS. 1 and 2, a drum washing machine 1 according to an embodiment of the present disclosure may include a washing machine body 3 and a door 10.

The washing machine body 3 forms an outer appearance of the drum washing machine 1, and a laundry loading opening 5 through which laundry may be inserted into and removed from the inside of the washing machine body 3 is provided in a front surface of the washing machine body 3. A control panel 7 for controlling the drum washing machine 1 is provided at the upper part of the front surface of the washing machine body 3.

A cylindrical washing tub is provided inside the washing machine body 3, and has an opening toward the laundry loading opening 5. The washing tub is formed by a double structure of a stationary tub and a rotary tub 9. The stationary tub accommodates washing water necessary for washing, and the rotary tub 9 is rotatably disposed inside the stationary to perform washing.

A water supply device for supplying the washing water to the stationary tub is provided above the stationary tub. A drain device for draining the washing water from the stationary tub is provided below the stationary tub.

The rotary tub 9 includes an opening formed at a position corresponding to the laundry loading opening 5 of the washing machine body 3 on the front surface thereof and a plurality of through holes formed in the surface of the rotary tub 9. Also, a plurality of lifts capable of lifting the laundry are provided on the inner surface of the rotary tub 9. The rotary tub 9 may be configured to be rotated on the horizontal axis by a driving device provided on the rear surface thereof.

The door 10 is provided on the front surface of the washing machine body 3 to open and close the laundry loading opening 5 of the washing machine body 3.

Hereinafter, the door for a drum washing machine according to an embodiment of the present disclosure will be described in detail with reference to FIGS. 3 and 4.

Figure 3:
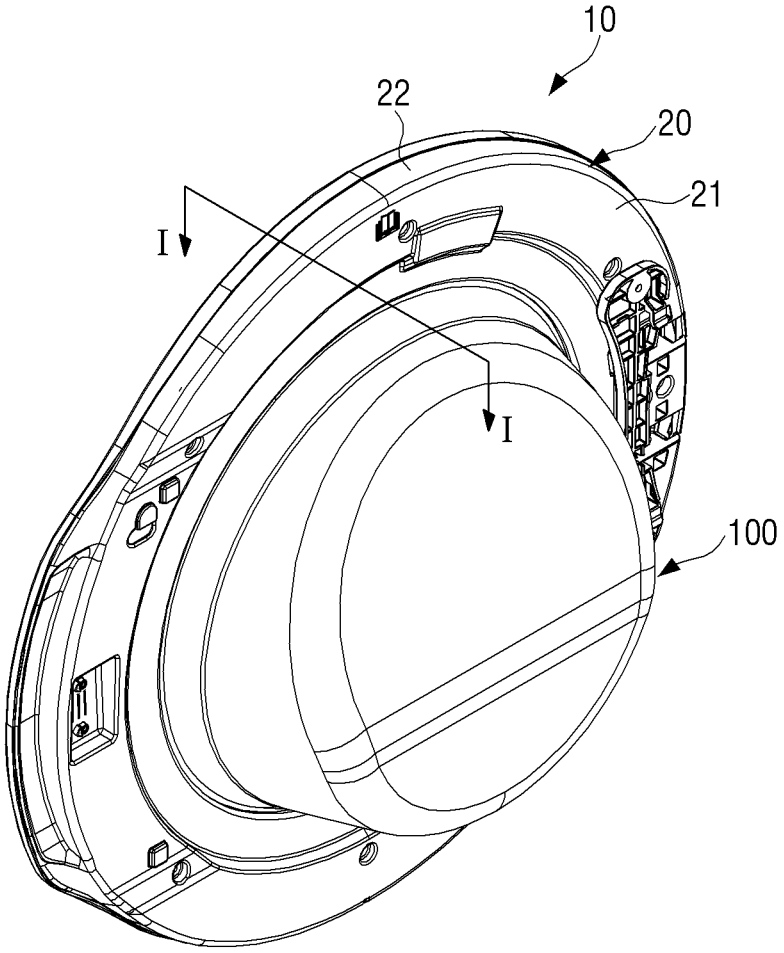
FIG. 3 is a perspective view illustrating a door for a drum washing machine according to an embodiment of the present disclosure.
Figure 4:
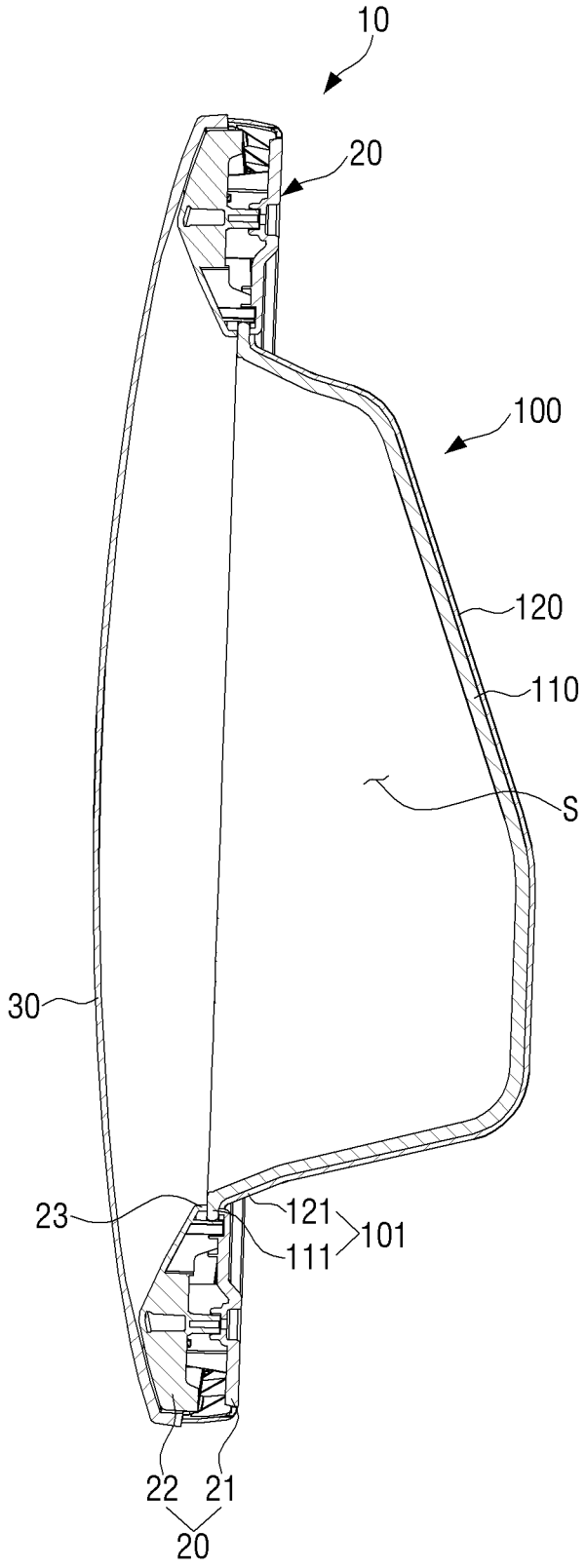
FIG. 4 is a cross-sectional view illustrating the door for a drum washing machine of FIG. 3 taken along a line I-I.

FIG. 3 is a perspective view illustrating a door for a drum washing machine according to an embodiment of the present disclosure, and FIG. 4 is a cross-sectional view illustrating the door for a drum washing machine of FIG. 3 taken along a line I-I.

Referring to FIGS. 3 and 4, the door 10 for a drum washing machine according to an embodiment of the present disclosure may include a door frame 20 and an inner door assembly 100.

The door frame 20 supports the inner door assembly 100, and is exposed to the outside when the door 10 closes the laundry loading opening 5 of the washing machine body 3. The door frame 20 is formed in a donut shape, and has a fixing hole 23 which the inner door assembly 100 is inserted into and fixed to at the center thereof. The door frame 20 may be formed of two frame members, that is, a first frame member 21 and a second frame member 22 to fix the inner door assembly 100. When the inner door assembly 100 is inserted into the fixing hole 23 of the first frame member 21 and the second frame member 22 is coupled to the first frame member 21, the inner door assembly 100 is fixed to the door frame 20. In detail, a rim portion 101 of the inner door assembly 100 is fixed between the first and second frame members 21 and 22.

The door frame 20 is disposed by a hinge 11 at one side of the laundry loading opening 5 on the front surface of the washing machine body 3. Accordingly, the inner door assembly 100 fixed to the door frame 20 may open and close the laundry loading opening 5.

The door frame 20 may be provided with a protective cover 30 for blocking the fixing hole 23. Accordingly, the protective cover 30 closes an inner space S of the inner door assembly 100 fixed to the door frame 20.

The inner door assembly 100 may be formed in a shape projecting from the door frame 20, and may be inserted into the laundry loading opening 5 of the washing machine body 3. For example, the inner door assembly 100 may be formed in a bowl shape.

Hereinafter, a structure of an inner door assembly of a door for a drum washing machine according to an embodiment of the present disclosure will be described in detail with reference to FIGS. 5, 6, and 7.

Figure 5:
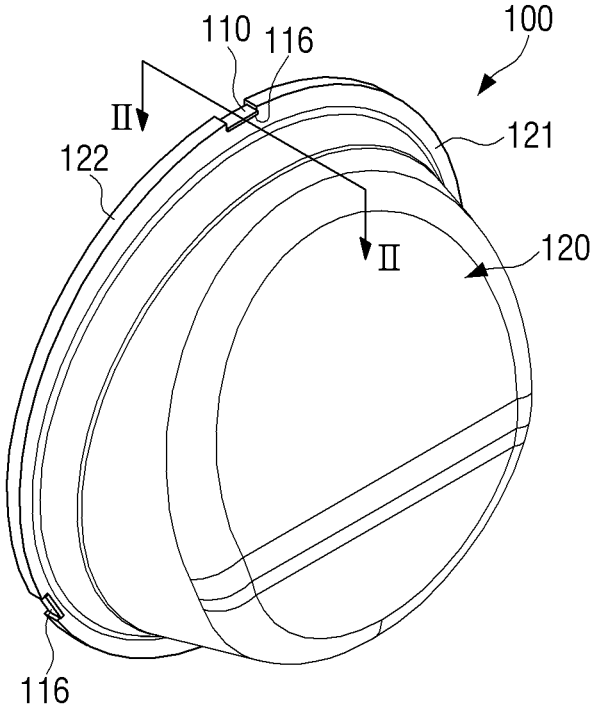
FIG. 5 is a perspective view illustrating an inner door assembly for a drum washing machine according to an embodiment of the present disclosure.

FIG. 5 is a perspective view illustrating an inner door assembly for a drum washing machine according to an embodiment of the present disclosure. FIG. 6 is an exploded perspective view illustrating the inner door assembly for a drum washing machine of FIG. 5, and FIG. 7 is a cross-sectional view illustrating the inner door assembly for a drum washing machine of FIG. 5 taken along a line II-II.

Figure 6:
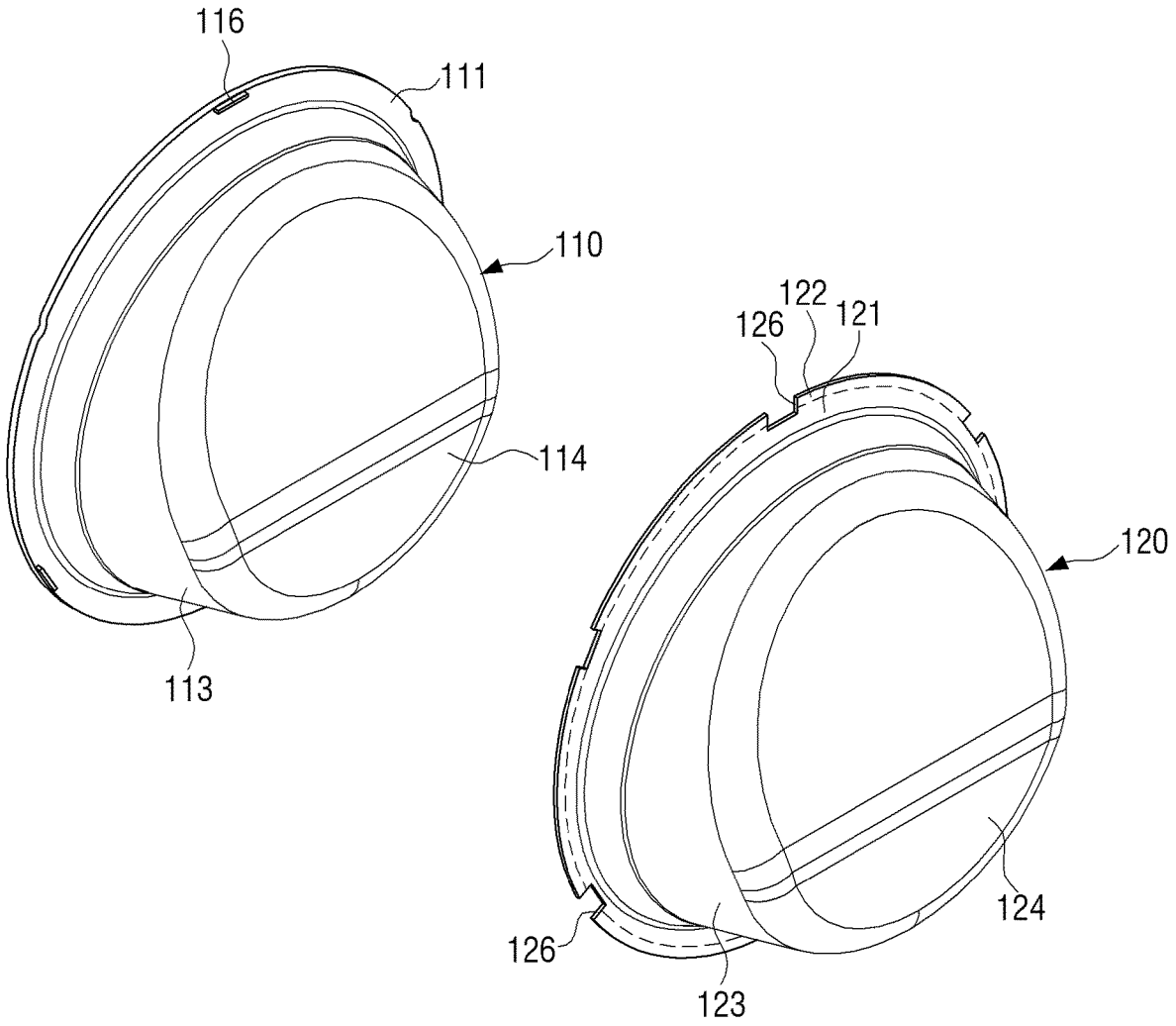
FIG. 6 is an exploded perspective view illustrating the inner door assembly for a drum washing machine of FIG. 5.
Figure 7:
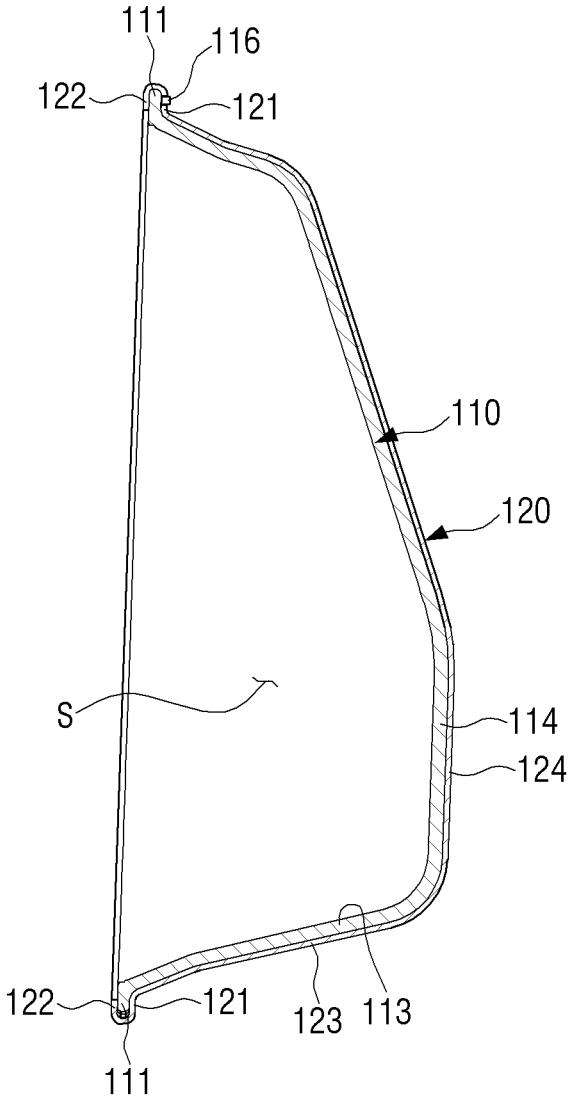
FIG. 7 is a cross-sectional view illustrating the inner door assembly for a drum washing machine of FIG. 5 taken along a line II-II.

Referring to FIGS. 5 to 7, an inner door assembly 100 according to an embodiment of the present disclosure may include an inner door internal shell 110 and an inner door external shell 120.

The inner door internal shell 110 may include a rim portion 111 of a substantially ring shape and a projecting portion 113 projecting from the rim portion 111 at a certain angle. The projecting portion 113 may be formed in a bowl shape having a bottom. Therefore, a space is formed inside the inner door internal shell 110. In detail, the projecting portion 113 may be formed to extend at a certain angle from the inner circumferential surface of the ring-shaped rim portion 111. The projecting portion 113 may be formed to have an obtuse angle with respect to the rim portion 111.

The projecting portion 113 of the inner door internal shell 110 is positioned inside the washing machine body 3 when the door 10 covers the laundry loading opening 5 of the washing machine body 3. The inner door internal shell 110 may be formed by injection molding of plastic. In other words, the inner door internal shell 110 may be formed of plastic that is easy to injection-mold with an injection machine.

The inner door external shell 120 may be formed in a shape corresponding to the inner door internal shell 110. For example, the inner door external shell 120 may include a rim portion 121 and a projecting portion 123 corresponding to the rim portion 111 and the projecting portion 113 of the inner door internal shell 110 as described above. Accordingly, the rim portion 121 of the inner door external shell 120 is formed in a substantially ring shape, and the projecting portion 123 is formed in a shape extending from the inner circumferential surface of the rim portion 121 at a certain angle. Also, the projecting portion 123 of the inner door external shell 120 may be formed in a bowl shape corresponding to the projecting portion 113 of the inner door internal shell 110.

The rim portion 121 and the projecting portion 123 of the inner door external shell 120 may be formed to have a larger dimension than those of the inner door internal shell 110 to accommodate the inner door internal shell 110 inside the inner door external shell 120. As illustrated in FIG. 7, the inner door external shell 120 may be formed so that the inner surface of the inner door external shell 120 is in contact with or adjacent to the outer surface of the inner door internal shell 110.

The inner door external shell 120 may be formed by press processing with a metal. For example, the inner door external shell 120 may be formed of the same stainless steel as the stationary tub and the rotary tub 9 disposed inside the washing machine body 3. Alternatively, the inner door external shell 120 may be formed of a corrosion-resistant material that is not corroded by washing water with detergent, and has a strength capable of withstanding impacts during washing.

The inner door external shell 120 is disposed on the outside of the inner door internal shell 110, and is combined not to be separated from the inner door internal shell 110. Accordingly, the inner door external shell 120 and the inner door internal shell 110 may be combined in various ways.

For example, the inner door external shell 120 and the inner door internal shell 110 may be combined by a curling process. Hereinafter, a curling process for combining an inner door external shell and an inner door internal shell will be described with reference to FIGS. 8A and 8B.

Figure 8A:
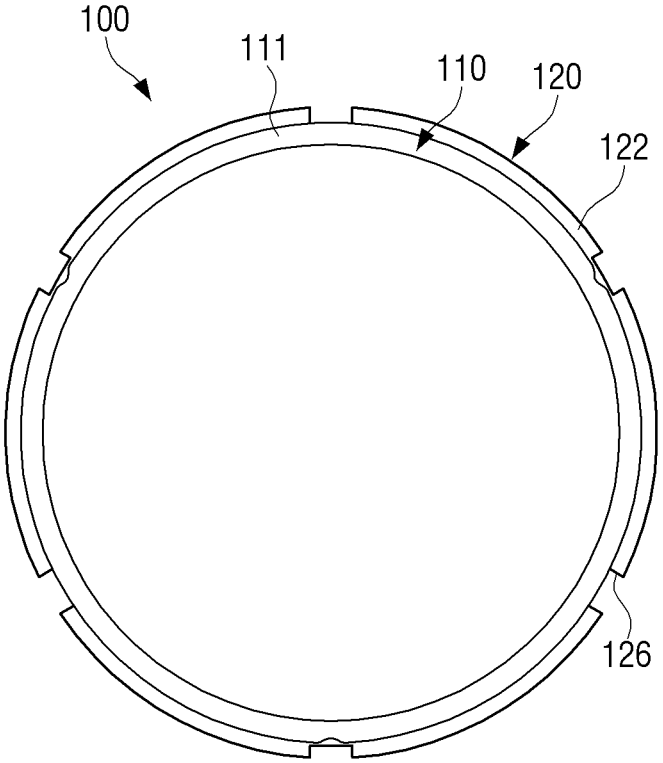
FIG. 8A is a plan view illustrating a state before a curling process is performed onto an inner door assembly for a drum washing machine according to an embodiment of the present disclosure.
Figure 8B:
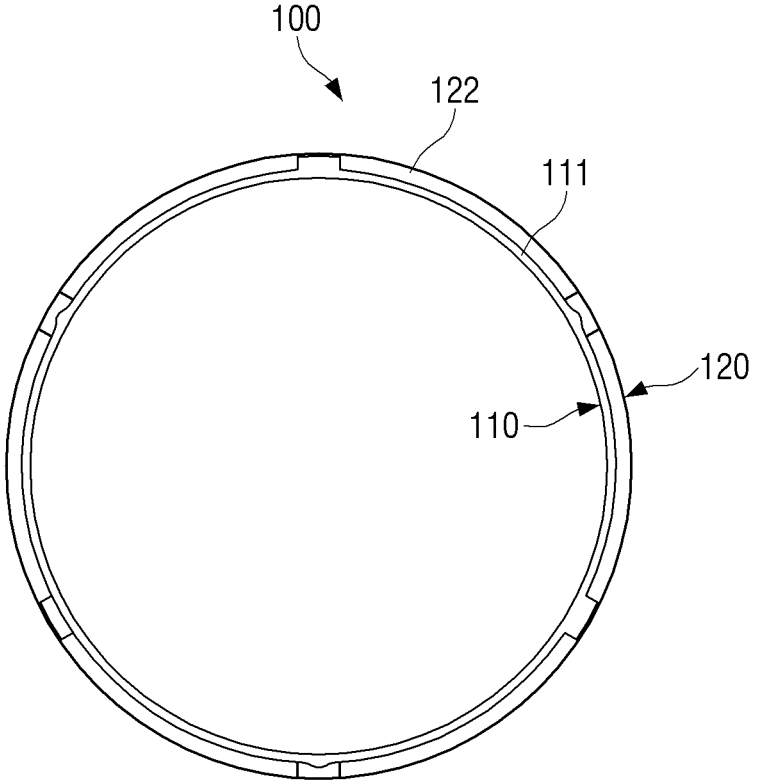
FIG. 8B is a plan view illustrating a state in which a curling process of an inner door assembly for a drum washing machine according to an embodiment of the present disclosure is completed.

FIG. 8A is a plan view illustrating a state before a curling process is performed on an inner door assembly for a drum washing machine according to an embodiment of the present disclosure, and FIG. 8B is a plan view illustrating a state in which the curling process of an inner door assembly for a drum washing machine according to an embodiment of the present disclosure is completed.

As illustrated in FIG. 8A, a curling portion 122 is provided at the rim portion 121 of the inner door external shell 120 for curling combination. The curling portion 122 is formed to extend outward from the rim portion 121 of the inner door external shell 120, and has a size that can wrap the rim portion 111 of the inner door internal shell 110. Accordingly, when the inner door internal shell 110 is inserted into the inner door external shell 120, as illustrated in FIG. 8A, the curling portion 122 of the inner door external shell 120 is projected outward the rim portion 111 of the inner door internal shell 110.

When the curling portion 122 of the inner door external shell 120 is folded by a curling machine or a curling jig in this state, the rim portion 111 of the inner door internal shell 110 is wrapped by the curling portion 122 of the inner door external shell 120 as illustrated in FIG. 8B. In other words, the curling portion 122 of the inner door external shell 120 is fixed to the rim portion 111 of the inner door internal shell 110. Accordingly, when the curling process is completed, the inner door external shell 120 and the inner door internal shell 110 are integrally combined and are not separated from each other.

Further, a plurality of fixing protrusions 116 may be provided at the rim portion 111 of the inner door internal shell 110, and a plurality of fixing grooves 126 into which the plurality of fixing protrusions 116 are inserted may be provided at the rim portion 121 of the inner door external shell 120. The plurality of fixing protrusions 116 are formed on the rear surface of the rim portion 111 of the inner door internal shell 110, that is, on one surface of the rim portion 111 of the inner door internal shell 110 in contact with the rim portion 121 of the inner door external shell 120. The fixing protrusions 116 are formed in a bar shape and bent at a curvature corresponding to the rim portion 111 of a ring shape, respectively.

The fixing grooves 126 of the inner door external shell 120 may be formed in a substantially rectangular shape corresponding to the fixing protrusions 116 of the inner door internal shell 110. Accordingly, when the plurality of fixing protrusions 116 of the inner door internal shell 110 are inserted into the plurality of fixing grooves 126 of the inner door external shell 120, the inner door internal shell 110 is not rotated with respect to the inner door external shell 120. The curling portion 122 is not provided at portions where the plurality of fixing grooves 126 of the inner door external shell 120 are formed. Accordingly, the curling portion 122 provided on the inner door external shell 120 may be formed in a plurality of portions divided by the plurality of fixing grooves 126.

When the inner door assembly 100 is formed by combining the inner door internal shell 110 and the inner door external shell 120 as described above, the inner door external shell 120 formed of metal may function to reinforce the strength, and the inner door internal shell 110 formed of plastic may serve to apply various designs to the door 10 of the drum washing machine 1.

For example, when the door 10 for the drum washing machine is closed, the inner door external shell 120 of the inner door assembly 100 made of metal is exposed to the inside of the washing machine body 3. Therefore, even when an impact is applied to the inner door assembly 100 during washing, the inner door external shell 120 made of metal may sufficiently withstand the impact. Further, since the inner door internal shell 110 is formed of plastic, the inner door internal shell 110 may be formed in various shapes because it has excellent processability unlike the glass used for the conventional door for the drum washing machine.

Although the outer surface of the inner door internal shell 110 and the inner surface of the inner door external shell 120 are in contact with or close to each other in the above description, a space may be provided between the inner door internal shell 110 and the inner door external shell 120.

Hereinafter, an inner door assembly having a space between an inner door internal shell and an inner door external shell will be described with reference to FIG. 9.

Figure 9:
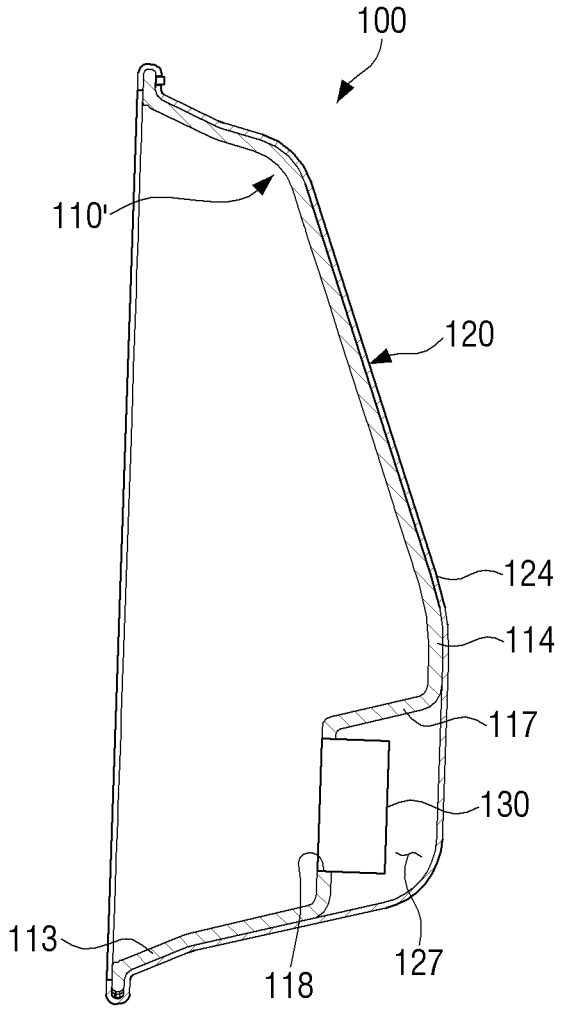
FIG. 9 is a cross-sectional view illustrating an inner door assembly for a drum washing machine according to another embodiment of the present disclosure.

FIG. 9 is a cross-sectional view illustrating an inner door assembly for a drum washing machine according to another embodiment of the present disclosure.

Referring to FIG. 9, the inner door internal shell 110' is formed such that the upper surface 114 of the projecting portion 113 is stepped. In other words, a step portion 117 lower than the height of the upper surface 114 is provided below the upper surface 114 of the inner door internal shell 110 toward the rim portion 111. The rim portion 111 and the remaining portion of the projecting portion 113 of the inner door internal shell 110 are formed to be in contact with the inner door external shell 120 in the same as the inner door internal shell 110 of the above-described embodiment. Accordingly, when the inner door internal shell 110' is inserted into the inner door external shell 120 and combined by the curling process, a space 127 is provided between the upper surface 114 of the projecting portion 113 of the inner door internal shell 110' and the upper surface 124 of the projecting portion 123 of the inner door external shell 120.

A display unit 130 may be disposed in the space 127. For example, the step portion 117 of the inner door internal shell 110' is provided with a through hole 118 through which a screen of the display unit 130 is exposed, and the display unit 130 may be accommodated in the space 127. Although not illustrated, electric wires for supplying signals and electricity required for the display unit 130 may be extended to the outside through between the inner door internal shell 110' and the inner door external shell 120, and may be connected to a controller of the drum washing machine 1.

In the present embodiment, the display unit 130 is disposed in the space 127 formed between the inner door internal shell 110' and the inner door external shell 120. However, a thing disposed in the space 127 between the inner door internal shell 110' and the inner door external shell 120 is not limited thereto. Various devices or parts capable of providing additional functions to the drum washing machine 1 may be disposed in the space 127 between the inner door internal shell 110' and the inner door external shell 120.

In the above description, the inner door internal shell 110 and the inner door external shell 120 of the inner door assembly 100 are combined by the curling process; however, a method for combining the inner door internal shell 110 and the inner door external shell 120 is not limited thereto. The inner door internal shell 110 and the inner door external shell 120 may be combined in various ways as long as the inner door internal shell 110 and the inner door external shell 120 cannot be separated from each other.

Hereinafter, another method for combining an inner door internal shell and an inner door external shell of an inner door assembly will be described with reference to FIGS. 10 and 11.

Figure 10:
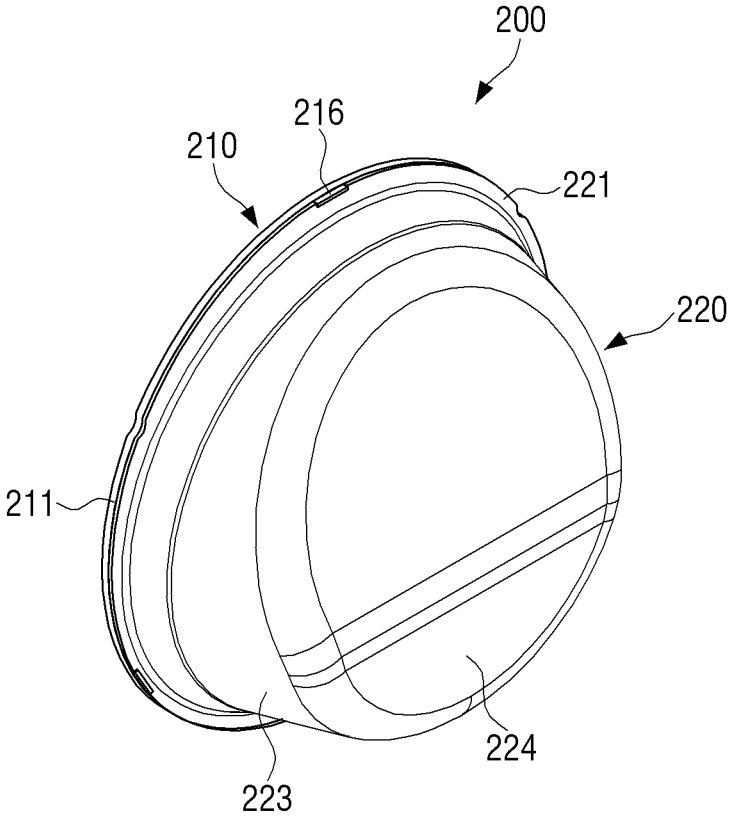
FIG. 10 is a perspective view illustrating an inner door assembly for a drum washing machine according to another embodiment of the present disclosure.
Figure 11:
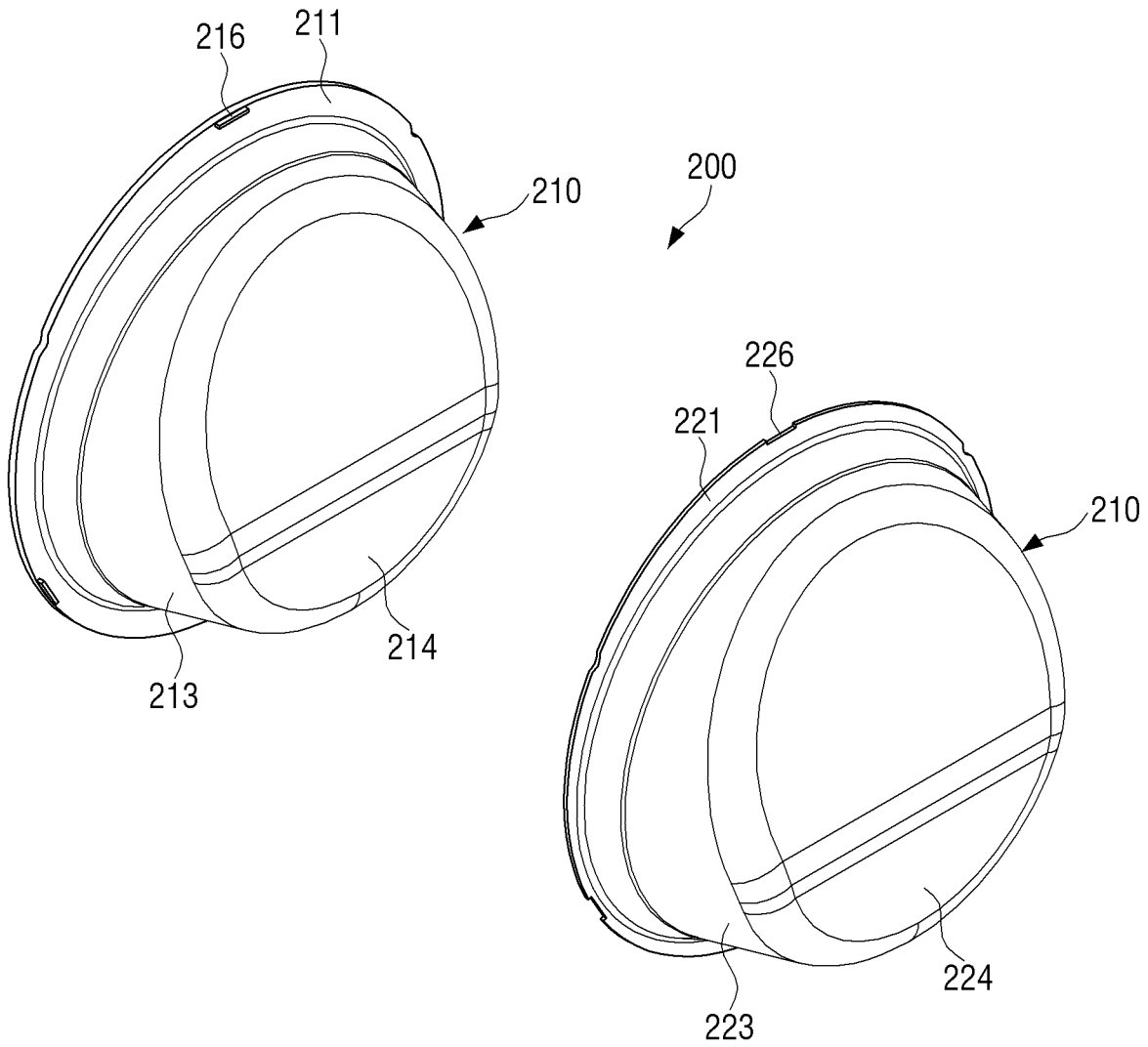
FIG. 11 is an exploded perspective view illustrating the inner door assembly for a drum washing machine of FIG. 10.

FIG. 10 is a perspective view illustrating an inner door assembly for a drum washing machine according to another embodiment of the present disclosure, and FIG. 11 is an exploded perspective view illustrating the inner door assembly for a drum washing machine of FIG. 10.

Referring to FIGS. 10 and 11, an inner door assembly 200 may include an inner door internal shell 210 and an inner door external shell 220.

The inner door internal shell 210 may include a rim portion 211 and a projecting portion 213 extending from the rim portion 211. A plurality of fixing protrusions 216 are provided at a predetermined interval in the rim portion 211 of the inner door internal shell 210. The inner door internal shell 210 is the same as or similar to the inner door internal shell 110 according to an embodiment of FIG. 6; therefore, a detailed description thereof is omitted.

The inner door external shell 220 may be formed to receive the inner door internal shell 210, and may include a rim portion 221 and a projecting portion 223 corresponding to the rim portion 211 and the projecting portion 213 of the inner door internal shell 210. In detail, the rim portion 221 of the inner door external shell 220 is formed in a substantially ring shape, and the projecting portion 223 is formed in a shape extending from the inner circumferential surface of the rim portion 221 at a certain angle with respect to the rim portion 221. Also, the projecting portion 223 of the inner door external shell 220 may be formed in a bowl shape corresponding to the projecting portion 213 of the inner door internal shell 210.

The rim portion 221 and the projecting portion 223 of the inner door external shell 220 may be formed to have a larger dimension than those of the inner door internal shell 210 to accommodate the inner door internal shell 210 in an inner space formed by the projecting portion 223. Accordingly, the inner door external shell 220 may be formed so that the inner surface of the inner door external shell 220 is in contact with or adjacent to the outer surface of the inner door internal shell 210. For example, the rim portion 211 of the inner door internal shell 210 may be in contact with the rim portion 221 of the inner door external shell 220, and the outer surface of the projecting portion 213 of the inner door internal shell 210 may be in contact with the inner surface of the projecting portion 223 of the inner door external shell 220. In particular, when the inner door internal shell 210 and the inner door external shell 220 are combined to each other, the upper surface 214 of the projecting portion 213 of the inner door internal shell 210 and the upper surface 224 of the projecting portion 223 of the inner door external shell 220 may be in contact with each other.

The rim portion 221 of the inner door external shell 220 may be provided with a plurality of fixing grooves 226 into which the plurality of fixing protrusions 216 provided at the inner door internal shell 210 are inserted. In detail, the outer circumferential surface of the rim portion 221 of the inner door external shell 220 is provided with the plurality of fixing grooves 226 which may be coupled to the plurality of fixing protrusions 216 formed on a rear surface of the rim portion 211 of the inner door internal shell 210, that is, one surface of the rim portion 211 of the inner door internal shell 210 in contact with the rim portion 221 of the inner door external shell 220. Since the plurality of fixing protrusions 216 of the inner door internal shell 210 are formed in a bent bar shape, the fixing grooves 226 are formed in a substantially bent rectangular shape corresponding to the fixing protrusion 216. Accordingly, when the plurality of fixing protrusions 216 of the inner door internal shell 210 are inserted into the plurality of fixing grooves 226 of the inner door external shell 220, the inner door internal shell 210 is fixed to the inner door external shell 220. Accordingly, the inner door internal shell 210 is not easily separated from the inner door external shell 220, and is not rotated with respect to the inner door external shell 220. Further, in order to increase the combining force between the inner door internal shell 210 and the inner door external shell 220, an adhesive may be applied between the inner door external shell 220 and the inner door internal shell 210.

As another example, although not illustrated, the inner door internal shell 210 and the inner door external shell 220 may be combined using screws.

In the above description, the inner door assemblies 100 and 200 have no through holes. However, a through hole may be formed in the inner door assembly so that laundry inside the washing machine body 3 can be seen.

Hereinafter, an inner door assembly for a drum washing machine having a through hole will be described in detail with reference to FIGS. 12 to 14.

Figure 12:
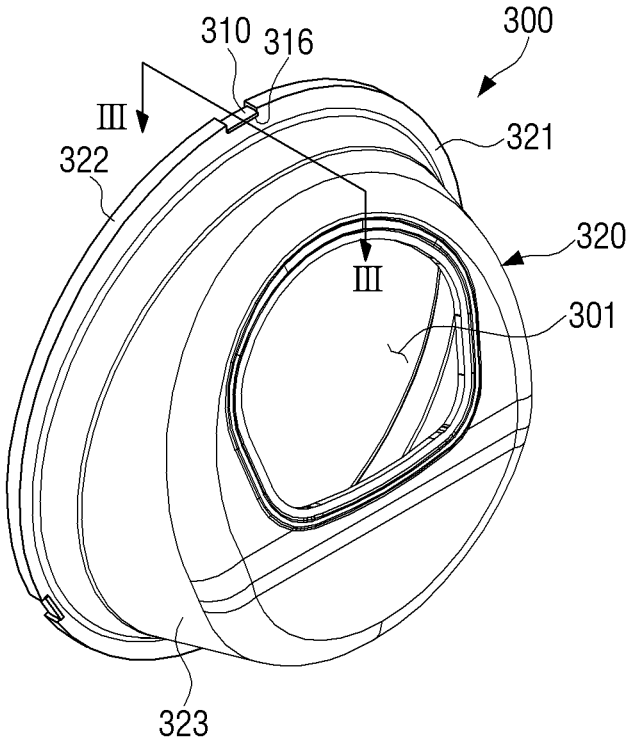
FIG. 12 is a perspective view illustrating an inner door assembly for a drum washing machine according to another embodiment of the present disclosure.
Figure 13:
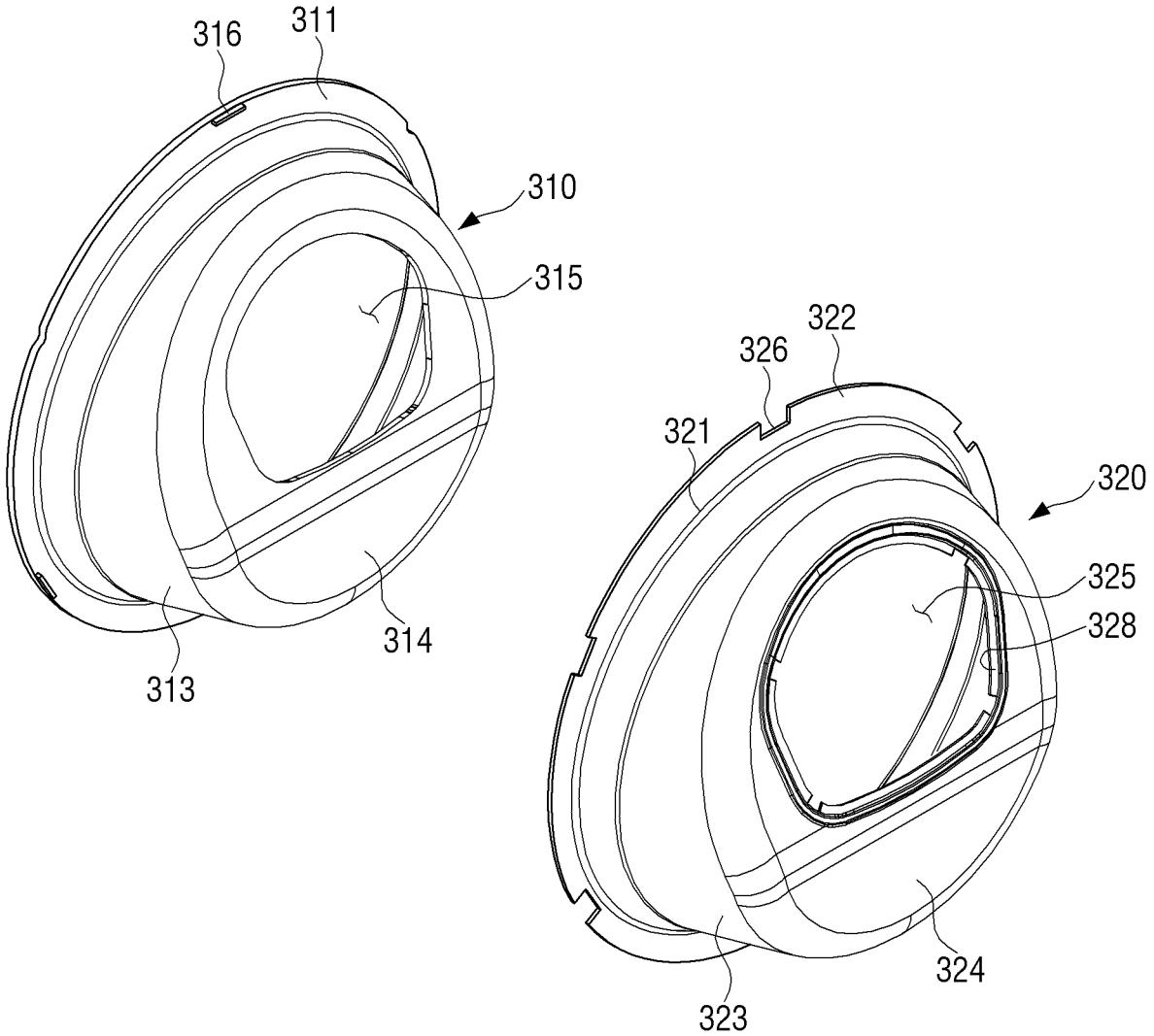
FIG. 13 is an exploded perspective view illustrating the inner door assembly for a drum washing machine of FIG. 12.

FIG. 12 is a perspective view illustrating an inner door assembly for a drum washing machine according to another embodiment of the present disclosure, and FIG. 13 is an exploded perspective view illustrating the inner door assembly for a drum washing machine of FIG. 12. FIG. 14 is a cross-sectional view illustrating the inner door assembly for a drum washing machine of FIG. 12 taken along a line III-III.

Figure 14:
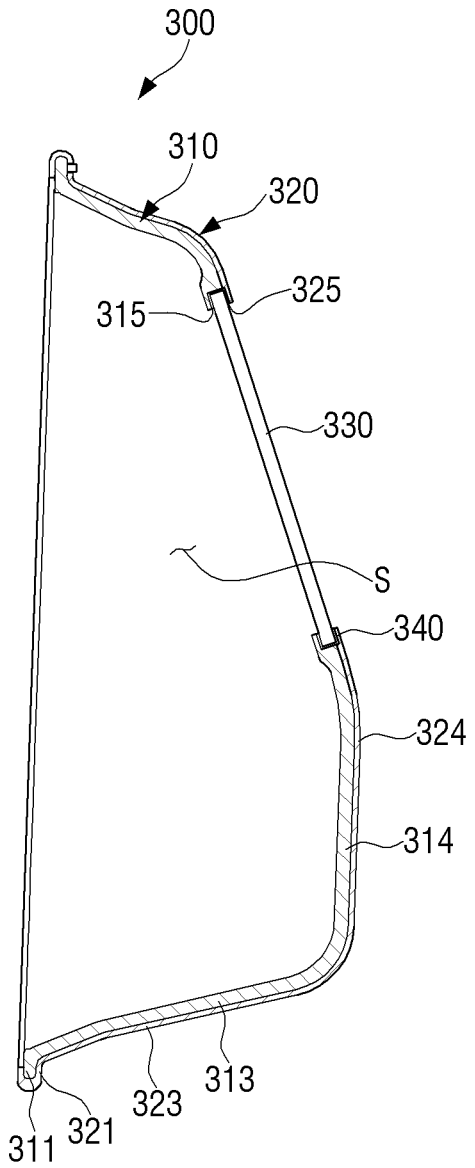
FIG. 14 is a cross-sectional view illustrating the inner door assembly for a drum washing machine of FIG. 12 taken along a line III-III.

Referring to FIGS. 12 to 14, an inner door assembly 300 according to an embodiment of the present disclosure may include an inner door internal shell 310 and an inner door external shell 320.

The inner door internal shell 310 may include a rim portion 311 of a substantially ring shape and a projecting portion 313 projecting from the rim portion 311. The projecting portion 313 may be formed in a bowl shape having a bottom. Therefore, a space is formed inside the inner door internal shell 310. In detail, the projecting portion 313 may be formed to extend at a certain angle from the inner circumferential surface of the ring-shaped rim portion 311. Accordingly, when the door 10 for the drum washing machine covers the laundry loading opening 5 of the washing machine body 3, the projecting portion 313 is positioned inside the washing machine body 3.

The upper surface 314 of the projecting portion 313 may be provided with a first opening 315 penetrating the upper surface 314 of the projecting portion 313. The shape of the first opening 315 may be formed in various shapes depending on its use.

Further, a plurality of fixing protrusions 316 may be provided at the rim portion 311 of the inner door internal shell 310. In detail, the plurality of fixing protrusions 316 may be formed on a rear surface of the rim portion 311 of the inner door internal shell 310, that is, on one surface of the rim portion 311 of the inner door internal shell 310 in contact with a rim portion 321 of the inner door external shell 320. Each of the fixing protrusions 116 may be formed in a bar shape bent at a curvature corresponding to the rim portion 311 of a ring shape.

The inner door internal shell 310 may be formed by injection molding of plastic having good moldability.

The inner door external shell 320 may be formed in a shape corresponding to the inner door internal shell 310. For example, the inner door external shell 320 may include the rim portion 321 and a projecting portion 323 corresponding to the rim portion 311 and the projecting portion 313 of the inner door internal shell 310 as described above. Accordingly, the rim portion 321 of the inner door external shell 320 is formed in a substantially ring shape, and the projecting portion 323 is formed in a shape extending from the inner circumferential surface of the rim portion 321 at a certain angle with respect to the rim portion 321. In other words, the projecting portion 323 of the inner door external shell 320 may be formed in a bowl shape corresponding to the projecting portion 313 of the inner door internal shell 310.

The rim portion 321 and the projecting portion 323 of the inner door external shell 320 may be formed to have a larger dimension than those of the inner door internal shell 310 to accommodate the inner door internal shell 310 in an inner space thereof. As illustrated in FIG. 14, the inner door external shell 320 may be formed so that the inner surface of the inner door external shell 320 is in contact with or adjacent to the outer surface of the inner door internal shell 310.

The projecting portion 323 of the inner door external shell 320 may be provided with a second opening 325 formed in a shape corresponding to the first opening 315 of the inner door internal shell 310. Accordingly, when the inner door external shell 320 and the inner door internal shell 310 are combined, the first opening 315 and the second opening 325 are in a fluid communication with each other. Therefore, the projecting portion 323 of the inner door assembly 300 is provided with an opening 301 in fluid communication with the inner space S of the inner door assembly 300 and the outside.

The rim portion 321 of the inner door external shell 320 may be provided with a plurality of fixing grooves 326 into which a plurality of fixing protrusions 316 provided at the inner door internal shell 310 are inserted. In detail, the outer circumferential surface of the rim portion 321 of the inner door external shell 320 is provided with the plurality of fixing grooves 326 into which the plurality of fixing protrusions 316 formed on a rear surface of the rim portion 311 of the inner door internal shell 310, that is, one surface of the rim portion 311 of the inner door internal shell 310 in contact with the rim portion 321 of the inner door external shell 320 can be inserted. Since the fixing protrusions 316 of the inner door internal shell 310 are formed in a bent bar shape, the fixing grooves 326 of the inner door external shell 320 are formed in a substantially bent rectangular groove shape corresponding to the fixing protrusions 316 of the inner door internal shell 310, respectively. Accordingly, when the plurality of fixing protrusions 316 of the inner door internal shell 310 are inserted into the plurality of fixing grooves 326 of the inner door external shell 320, the inner door internal shell 310 is not rotated with respect to the inner door external shell 320.

The inner door external shell 320 may be formed by pressing a metal, for example, stainless steel.

The inner door internal shell 310 is inserted into the inner door external shell 320, and is combined with the inner door external shell 320 so that the inner door internal shell 310 is not separated from the inner door external shell 320. For example, the inner door external shell 320 and the inner door internal shell 310 may be combined by the curling process.

A curling portion 322 may be provided at the rim portion 321 of the inner door external shell 320 when the inner door external shell 320 and the inner door internal shell 310 are combined by the curling process. The structure of the curling portion 322 is the same as or similar to that of the curling portion 122 of the inner door external shell 120 of the inner door assembly 100 according to the above-described embodiment; therefore, a detailed description thereof is omitted.

In the present embodiment, since the inner door internal shell 310 is provided with a first opening 315 and the inner door external shell 320 is provided with a second opening 325, a curling portion 328 may be provided around the second opening 325 for the combination of the first opening 315 and the second opening 325. The curling portion 328 may be formed to wrap a circumference of the first opening 315 of the inner door internal shell 310.

A transparent member 330 may be provided between the first opening 315 of the inner door internal shell 310 and the second opening 325 of the inner door external shell 320. A seal 340 may be provided around the transparent member 330 to prevent the washing water of the washing machine body 3 from entering the space S of the inner door assembly 300. The transparent member 330 may be formed of transparent glass or transparent plastic. Accordingly, the user may check the laundry contained in the washing machine body 3 through the transparent member 330 provided in the inner door assembly 300.

In the above description, the opening 301 formed in the inner door assembly 300 is used as an inspection window for checking the laundry. However, the use of the opening 301 is not limited thereto. For example, the opening of the inner door assembly may be used as an additional laundry loading path through which additional laundry may be introduced.

Hereinafter, a door for a drum washing machine provided with an additional laundry loading path in an inner door assembly will be described with reference to FIG. 15.

Figure 15:
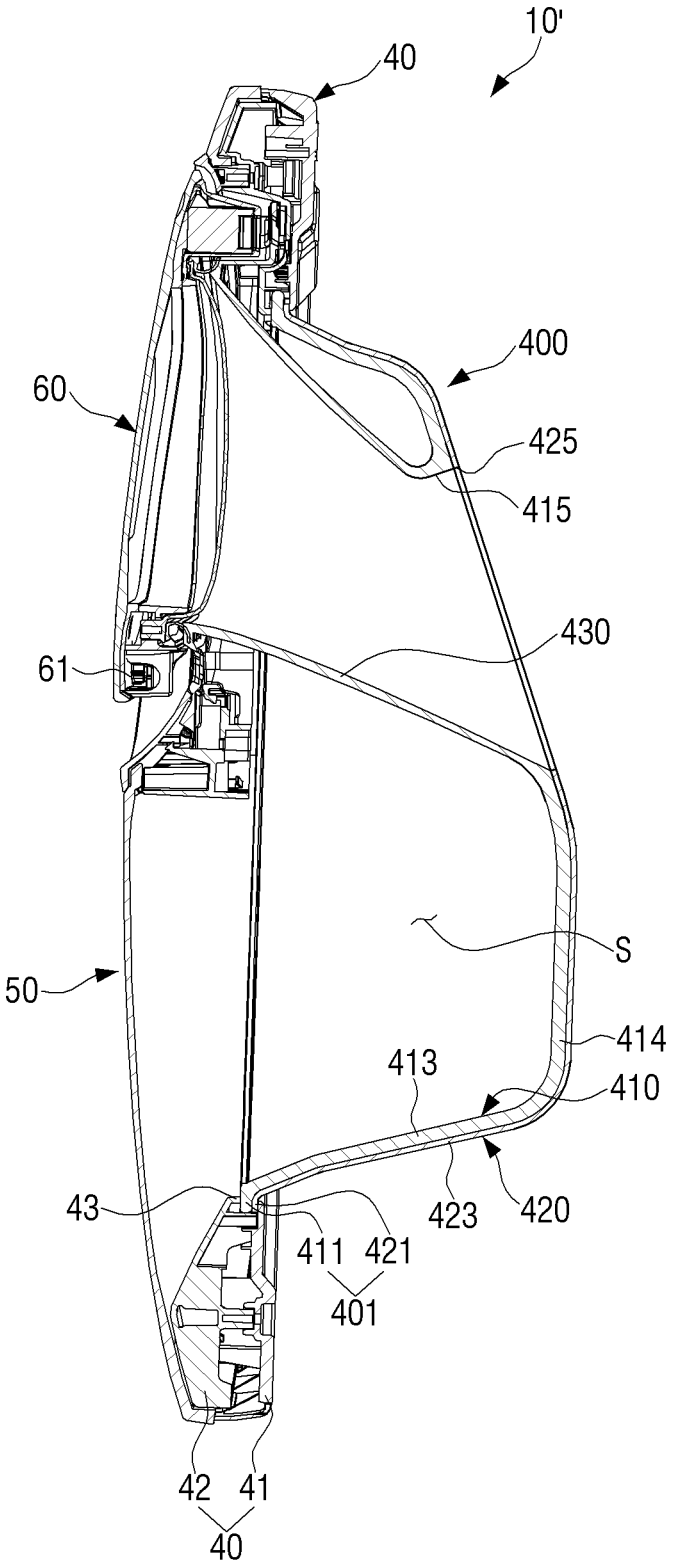
FIG. 15 is a cross-sectional view illustrating a door for a drum washing machine according to another embodiment of the present disclosure.

FIG. 15 is a cross-sectional view illustrating a door for a drum washing machine according to another embodiment of the present disclosure.

Referring to FIG. 15, a door 10' for a drum washing machine according to an embodiment of the present disclosure may include a door frame 40 and an inner door assembly 400.

The door frame 40 supports the inner door assembly 400, and is exposed to the outside when the door 10' closes the laundry loading opening 5 of the washing machine body 3. The door frame 40 may be formed in a donut shape, and have a fixing hole 43 which the inner door assembly 400 is inserted into and fixed to at the center thereof. The door frame 40 may be formed of two frame members, that is, a first frame member 41 and a second frame member 42 to fix the inner door assembly 400. When the inner door assembly 400 is inserted into the fixing hole 43 of the first frame member 41 and the second frame member 42 is coupled to the first frame member 42, a rim portion 401 of the inner door assembly 400 is fixed by the first and second frame members 41 and 42.

The door frame 40 is hinge-connected at one side of the laundry loading opening 5 on the front surface of the washing machine body 3. Accordingly, the inner door assembly 400 fixed to the door frame 40 may open and close the laundry loading opening 5.

The door frame 40 may be provided with a protective cover 50 for covering the fixing hole 43.

The inner door assembly 400 is formed in a shape projecting from the door frame 40, and may be inserted into the laundry loading opening 5 of the washing machine body 3. The inner door assembly 400 may include an inner door internal shell 410 and an inner door external shell 420.

The inner door internal shell 410 may include a rim portion 411 of a substantially ring shape and a projecting portion 413 projecting from the rim portion 411. The projecting portion 413 may be formed in a bowl shape having a bottom. Therefore, a space S is formed inside the inner door internal shell 410. In detail, the projecting portion 413 of the inner door internal shell 410 may be formed in a shape to extend at a certain angle, for example, at an obtuse angle from the inner circumferential surface of the ring-shaped rim portion 411.

The upper surface 414 of the projecting portion 413 of the inner door internal shell 410 is provided with a first opening 415 passing through the upper surface 414 of the projecting portion 413, and an additional laundry loading passage 430 is provided to extend from the first opening 415 toward the rim portion 411. The cross-section of the additional laundry loading passage 430 may be formed in a substantially rectangular shape.

In addition, a plurality of fixing protrusions may be provided on the rim portion 411 of the inner door internal shell 410 in the same manner as the inner door internal shell 110 according to the above-described embodiment. In detail, the plurality of fixing protrusions may be formed on a rear surface of the rim portion 411 of the inner door internal shell 410, that is, on one surface of the rim portion 411 of the inner door internal shell 410 in contact with a rim portion 421 of the inner door external shell 420.

The inner door internal shell 410 may be formed by injection molding of a plastic having good injection properties.

The inner door external shell 420 may be formed in a shape corresponding to the inner door internal shell 410. For example, the inner door external shell 420 may include the rim portion 421 and a projecting portion 423 corresponding to the rim portion 411 and the projecting portion 413 of the inner door internal shell 410 as described above. Accordingly, the rim portion 421 of the inner door external shell 420 is formed in a substantially ring shape, and the projecting portion 423 is formed in a shape extending from the inner circumferential surface of the rim portion 421 at a certain angle. In other words, the projecting portion 423 of the inner door external shell 420 may be formed in a bowl shape corresponding to the projecting portion 413 of the inner door internal shell 410.

The rim portion 421 and the projecting portion 423 of the inner door external shell 420 may be formed to have a larger dimension than those of the inner door internal shell 410 to accommodate the inner door internal shell 410 therein. As illustrated in FIG. 15, the inner door external shell 420 may be formed so that the inner surface of the inner door external shell 420 is in contact with or adjacent to the outer surface of the inner door internal shell 410.

The projecting portion 423 of the inner door external shell 420 may be provided with a second opening 425 formed in a shape corresponding to the first opening 415 of the inner door internal shell 410. Accordingly, when the inner door external shell 420 and the inner door internal shell 410 are combined, the first opening 415 and the second opening 425 are in fluid communication with each other. Therefore, the additional laundry loading passage 430 extending from the first opening 415 of the inner door internal shell 410 is in fluid communication with the outside of the inner door assembly 400 through the second opening 425 of the inner door external shell 420. Accordingly, the user can further add laundry into the washing machine body 3 by using the additional laundry loading passage 430 of the inner door assembly 400.

The rim portion 421 of the inner door external shell 420 may be provided with a plurality of fixing grooves into which a plurality of fixing protrusions provided at the inner door internal shell 410 are inserted in the same manner as the inner door external shell 120 according to the above-described embodiment. In detail, the outer circumferential surface of the rim portion 421 of the inner door external shell 420 may be provided with the plurality of fixing grooves into which the plurality of fixing protrusions formed on a rear surface of the rim portion 411 of the inner door internal shell 410, that is, one surface of the rim portion 411 of the inner door internal shell 410 in contact with the rim portion 421 of the inner door external shell 420 are inserted. Accordingly, when the plurality of fixing protrusions of the inner door internal shell 410 are inserted into the plurality of fixing grooves of the inner door external shell 420, the inner door internal shell 410 is fixed to and is not rotated with respect to the inner door external shell 420.

The inner door external shell 420 may be formed by pressing a metal, for example, stainless steel.

The inner door internal shell 410 is inserted into the inner door external shell 420, and is combined with the inner door external shell 420 so that the inner door internal shell 410 is not separated from the inner door external shell 420. For example, the inner door external shell 320 and the inner door internal shell 310 may be combined by the curling process.

The protective cover 50 provided on the door 10' for the drum washing machine may be provided with a lid 60 for opening and closing the additional laundry loading passage 430 as described above. The lid 60 is coupled to the protective cover 30 by a hinge, thereby opening and closing the additional laundry loading passage 430 of the inner door assembly 400.

When the door 10' for the drum washing machine is closed, the inner door assembly 400 is located inside the washing machine body 3. Therefore, if necessary, the user may open the lid 60 provided on the protective cover 30, and then further introduce laundry into the washing machine body 3 by using the additional laundry loading passage 430 while the door 10' for the drum washing machine is closing the laundry loading opening 5.

In the above description, the additional laundry loading passage 430 is injection-molded integrally with the inner door internal shell 410; however, the structure of the additional laundry loading passage 430 is not limited thereto. As another example, although not illustrated, an additional laundry loading passage may be formed separately from the inner door internal shell 410, and then coupled to the inner door internal shell 410.

The inner door assembly according to an embodiment of the present disclosure as described above may be manufactured by the following method.

First, plastic is injected by an injection machine or an injection device to produce an inner door internal shell. At the same time, an inner door external shell is manufactured by a separated process.

The inner door external shell may be formed by pressing a metal having corrosion resistance and rigidity, for example, stainless steel.

Thereafter, when the inner door internal shell is inserted into the inner door external shell, and the inner door internal shell is fixed to the inner door external shell, the inner door assembly is completed. At this time, the inner door internal shell and the inner door external shell may be combined by various methods. For example, the inner door internal shell and the inner door external shell may be combined and fixed by a curling process. At this time, the inner door external shell is provided with a curling portion for combination between the inner door internal shell and the inner door external shell.

While the embodiments of the present disclosure have been described, additional variations and modifications of the embodiments may occur to those skilled in the art once they learn of the basic inventive concepts. Therefore, it is intended that the appended claims shall be construed to include both the above embodiments and all such variations and modifications that fall within the spirit and scope of the inventive concepts.

What is claimed is:

1. An inner door assembly for a drum washing machine comprising:

an inner door internal shell comprising a rim portion and a projecting portion formed from a plastic without glass material, the projecting portion projecting from an inner circumferential surface of the rim portion and having a substantially bowl shape; and an inner door external shell comprising a rim portion and a projecting portion formed from a metal without the glass material, the rim portion and the projecting portion of the inner door external shell corresponding to the rim portion and the projecting portion of the inner door internal shell, wherein the inner door external shell is combined in a manner to not be separated from the inner door internal shell.

2. The inner door assembly for the drum washing machine of claim 1, wherein:

the rim portion of the inner door external shell further includes a curling portion, and the curling portion of the inner door external shell is fixed to the rim portion of the inner door internal shell by a curling process.

3. The inner door assembly for the drum washing machine of claim 1, wherein:

the rim portion of the inner door internal shell is provided with a plurality of fixing protrusions, and the rim portion of the inner door external shell is provided with a plurality of fixing grooves into which the plurality of fixing protrusions are inserted.

4. The inner door assembly for the drum washing machine of claim 1, wherein:

the projecting portion of the inner door internal shell is provided with a first opening, and the projecting portion of the inner door external shell is provided with a second opening corresponding to the first opening.

5. The inner door assembly for the drum washing machine of claim 4, wherein the second opening of the inner door external shell is provided with a curling portion that wraps a circumference of the first opening of the inner door internal shell.

6. The inner door assembly for the drum washing machine of claim 1, wherein the inner door internal shell is formed by an injection process.

7. The inner door assembly for the drum washing machine of claim 6, wherein the inner door external shell is formed of stainless steel.

8. The inner door assembly for the drum washing machine of claim 7, wherein the inner door external shell is formed by a pressing process.

9. A door for a drum washing machine comprising:

an inner door assembly inserted into a laundry loading opening of the drum washing machine; and a door frame including a fixing hole into which the inner door assembly is inserted, and disposed in the drum washing machine so that the inner door assembly opens and closes the laundry loading opening of the drum washing machine, wherein the inner door assembly comprises:

an inner door internal shell comprising a rim portion and a projecting portion formed from a plastic without glass material, the projecting portion projecting from an inner circumferential surface of the rim portion and having a substantially bowl shape; and an inner door external shell comprising a rim portion and a projecting portion formed from a metal without the glass material, the rim portion and the projecting portion of the inner door external shell corresponding to the rim portion and the projecting portion of the inner door internal shell, wherein the inner door external shell is combined in a manner to not be separated from the inner door internal shell.

10. The door for the drum washing machine of claim 9, wherein:

the rim portion of the inner door external shell further includes a curling portion, and the curling portion of the inner door external shell is fixed to the rim portion of the inner door internal shell by a curling process.

11. The door for the drum washing machine of claim 9, wherein:

the rim portion of the inner door internal shell is provided with a plurality of fixing protrusions, and the rim portion of the inner door external shell is provided with a plurality of fixing grooves into which the plurality of fixing protrusions are inserted.

12. The door for the drum washing machine of claim 9, wherein:

the projecting portion of the inner door internal shell is provided with a first opening, and the projecting portion of the inner door external shell is provided with a second opening corresponding to the first opening.

13. The door for the drum washing machine of claim 12, wherein the second opening of the inner door external shell is provided with a curling portion that wraps a circumference of the first opening of the inner door internal shell.

14. The door for the drum washing machine of claim 12, wherein an additional laundry loading passage connected to the first opening is provided inside the projecting portion of the inner door internal shell.

15. The door for the drum washing machine of claim 14, wherein a lip is provided in an end of the additional laundry loading passage.

16. The door for the drum washing machine of claim 9, wherein the door frame further includes a protective cover to block the fixing hole.

17. A drum washing machine comprising:

a washing machine body including a laundry loading opening into which laundry is introduced; and a door disposed in the washing machine body and configured to open and close the laundry loading opening, wherein the door comprises:

an inner door assembly inserted into the laundry loading opening; and a door frame including a fixing hole to which the inner door assembly is fixed, and disposed by a hinge in the drum washing machine so that the inner door assembly opens and closes the laundry loading opening, wherein the inner door assembly comprises:

an inner door internal shell comprising a rim portion and a projecting portion formed from a plastic without glass material, the projecting portion projecting from an inner circumferential surface of the rim portion and having a substantially bowl shape; and an inner door external shell comprising a rim portion and a projecting portion formed from a metal without the glass material, the rim portion and the projecting portion of the inner door external shell corresponding to the rim portion and the projecting portion of the inner door internal shell, wherein the inner door external shell is combined in a manner to not be separated from the inner door internal shell.

18. The drum washing machine of claim 17, wherein:

the rim portion of the inner door external shell further includes a curling portion, and the curling portion of the inner door external shell is fixed to the rim portion of the inner door internal shell by a curling process.

19. The drum washing machine of claim 17, wherein:

the projecting portion of the inner door internal shell is provided with a first opening, and the projecting portion of the inner door external shell is provided with a second opening corresponding to the first opening.

20. The drum washing machine of claim 17, wherein:

the inner door internal shell is formed by an injection-molding process, and the inner door external shell is formed by pressing stainless steel.

* * * * *